US006401645B1

(12) United States Patent
Ansay et al.

(10) Patent No.: US 6,401,645 B1
(45) Date of Patent: Jun. 11, 2002

(54) VEHICLE LAUNCH ASSEMBLY FOR UNDERWATER PLATFORMS

(75) Inventors: Michael T. Ansay, Exeter, RI (US); Joseph A. Carreiro, New Bedford, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/656,196

(22) Filed: Sep. 6, 2000

(51) Int. Cl.[7] ..... B63B 1/00

(52) U.S. Cl. ..... 114/238; 89/1.8; 89/1.81; 89/1.809; 124/69

(58) Field of Search ..... 114/319, 238; 89/1.809, 1.81; 124/69

(56) References Cited

U.S. PATENT DOCUMENTS

| | | | | |
|---|---|---|---|---|
| 1,985,184 | A | * | 12/1934 | Methlin |
| 4,527,502 | A | * | 7/1985 | Schmitt |
| 4,848,210 | A | * | 7/1989 | Bissonnette |
| 5,099,745 | A | * | 3/1992 | Hubbell et al. |
| 5,200,572 | A | * | 4/1993 | Bissonnette et al. |
| 5,231,241 | A | * | 7/1993 | Bissonnette |
| 5,410,978 | A | * | 5/1995 | Waclawik et al. |
| 5,421,244 | A | * | 6/1995 | Hubbell et al. |
| 5,438,948 | A | * | 8/1995 | Moody |
| 5,495,819 | A | * | 3/1996 | Marion |
| 6,216,626 | B1 | * | 4/2001 | Curtis |
| 6,220,196 | B1 | * | 4/2001 | Escarrat |

FOREIGN PATENT DOCUMENTS

| | | | |
|---|---|---|---|
| DE | 2462267 A1 | * | 3/1977 |
| FR | 553125 | * | 5/2001 |

* cited by examiner

*Primary Examiner*—Michael J. Carone
*Assistant Examiner*—Troy Chambers
(74) *Attorney, Agent, or Firm*—Michael J. McGowan; James M. Kasischke; Pritvi C. Lall

(57) ABSTRACT

A vehicle launch assembly for underwater platforms includes a water tank mounted on the platform, and a plunger movably disposed in the tank and dividing the tank into first and second zones, the first zone being in communication with a. water environment in which the platform is disposed, and the second zone being in communication with a launch tube inlet line mounted on the platform. An actuator is connected to the plunger and is operable to move the plunger in the tank. A triggering device initiates operation of the actuator, moving the plunger in the tank to push water from the tank second zone to the launch tube inlet line to eject a vehicle from the launch tube, or moving the plunger to enlarge the tank second zone to draw water thereinto from a valve in communication with the water environment and the tank.

15 Claims, 4 Drawing Sheets

VEHICLE LAUNCH ASSEMBLY FOR UNDERWATER PLATFORMS

STATEMENT OF GOVERNMENT INTEREST

The invention described herein may be manufactured and used by and for the Government of the United States of America for Governmental purposes without the payment of any royalties thereon or therefor.

BACKGROUND OF THE INVENTION (1) Field of the Invention

The invention relates to vehicle launching apparatus and is directed more particularly to a vehicle launching assembly for underwater platforms, such as submarines.

(2) Description of the Prior Art

The launching of torpedoes, mines, vertically fired weapons, countermeasures, and the like, all hereinafter referred to as "vehicles", is generally well known. Over time, a few preferred types of systems have become prominent. The existing preferred systems include turbine pump ejection systems (TPES), air turbine pump (ATP) systems, and elastomeric ejection systems (EES), with the ATP and EES gaining favor in recent submarine design and construction.

Unfortunately, the ATP launcher has proven technically complex and expensive, and requires periodic overhauls. The EES launcher requires a special recharge pump to inflate an elastomeric bladder, and a special slide valve to control launch transients. Further, the EES elastomeric bladder material fatigues over time and requires replacement.

Thus, despite advances in the art, there still remains a need for a launcher system which is low in cost of both manufacture and maintenance, high in operational reliability, and quiet in operation, criteria not met by present ATP and EES assemblies.

SUMMARY OF THE INVENTION

Accordingly, an object of the invention is to provide a vehicle launch assembly for underwater platforms, which assembly comprises known and relatively non-complex components which provide economy of manufacture and maintenance, and which exhibits high reliability and acoustic advantages over the aforementioned current launch systems.

With the above and other objects in view, as will hereinafter appear, a feature of the present invention is the provision of a vehicle launch assembly for underwater platforms. The assembly includes a water tank mounted on the platform, and a plunger movably disposed in the tank and dividing the tank into first and second zones, the first zone being in communication with a water environment in which the platform is disposed, and the second zone being in communication with a launch tube inlet line mounted on the platform. An actuator is connected to the plunger and is operable to move the plunger in the tank. A triggering and reset device is provided for initiating operation of the actuator to move the plunger in the tank to effect a selected one of (1) moving the plunger to push water from the tank second zone to the launch tube inlet line to eject a vehicle from the launch tube, and (2) moving the plunger to enlarge the tank second zone to draw water thereinto from a valve in communication with the water environment and the tank second zone.

In accordance with a further feature of the invention, there is provided a vehicle launch assembly for underwater platforms. The assembly comprises a water tank mounted on the platform, a plunger movably disposed in the tank, the plunger comprising a rigid disc and an annular elastomeric seal fixed to a periphery of the disc and to an internal wall of the tank. The seal is stretchable to provide a bias on the plunger in a direction toward the second zone for ejecting a vehicle from a launch tube. A triggering device comprising key means retains the disc in a stationary condition, the key means being selectively movable to release the disc for movement in response to the bias of the elastomeric seal on the disc. A reset device comprises a cylinder, a drive rod extending from the cylinder and connected to the disc, a piston fixed to the drive rod and disposed in the cylinder, and force means in the cylinder and acting on the piston to move the drive rod to move the disc in the tank.

In accordance with a still further feature of the invention, there is provided a vehicle launch assembly for underwater platforms. The assembly comprises a water tank mounted on the platform, a plunger movably disposed in the tank, the plunger comprising a rigid disc and an annular elastomeric seal fixed to a periphery of the disc and to an internal wall of the tank, the seal being stretchable to provide a bias on the plunger in a direction toward the second zone for ejecting a vehicle from a launch tube. A triggering device comprises key means for retaining the disc in a stationary condition, the key means being selectively movable to release the disk for movement in response to the bias of the elastomeric seal on the disc in a direction toward the second zone to effect launch of a vehicle from a launch tube. A reset device comprises a cylinder, a shaft extending from the cylinder and slidingly through the disc, a piston fixed to the shaft and disposed in the cylinder, a body fixed to the shaft in the second zone, and force means in the cylinder and acting on the piston to move the shaft to move the body into engagement with the disc to move the disc in the tank to a position wherein the disc is engageable by the key means.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent, wherein corresponding reference characters indicate corresponding parts throughout the several views of the drawings and wherein.

DESCRIPTION OF THE PREFERRED EMBODIMENTS

Figure 1:
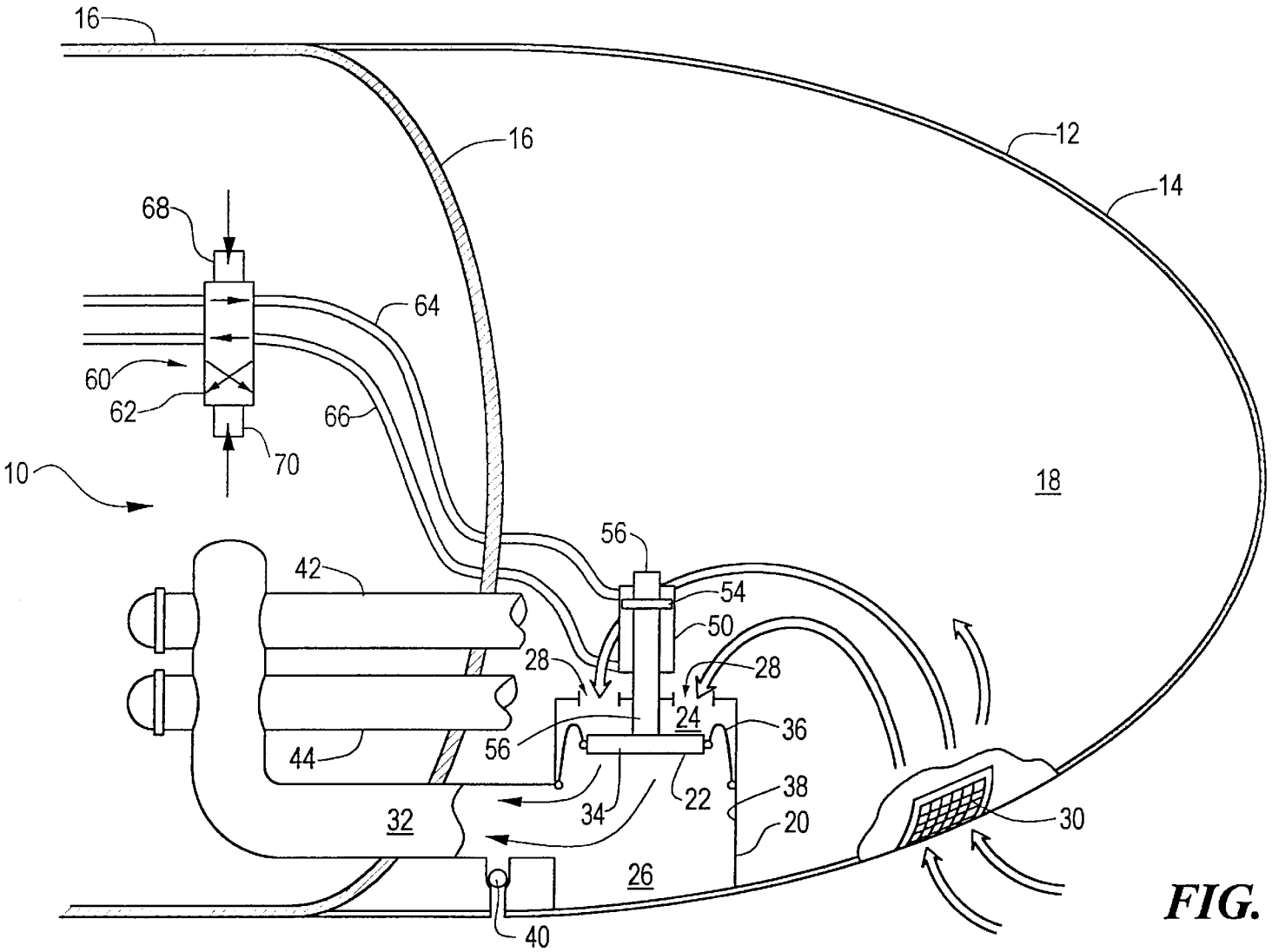
FIG. 1 is a diagrammatical view of one form of vehicle launch assembly illustrative of an embodiment of the invention.

Referring to FIG. 1, it will be seen that an illustrative launch assembly 10 may be mounted in a forward portion of a submarine 12, or other underwater platform. The submarine 12 typically is provided with a forward-most outer hull portion 14, known as the "bow dome". Proximate the base of the bow dome 14 is a pressure hull portion 16 extending athwartships and, in conjunction with bow dome 14, defining a free flood zone 18.

The launch assembly 10 includes a water tank 20, which may be mounted in free flood zone 18. A plunger 22 is disposed in tank 20 and divides the tank into first zone 24 and second zone 26. The first tank zone 24 is in communication with the free flood zone 18 by way of openings 28 in the tank 20. The free flood zone 18 is, in turn, adapted to receive water from the water environment in which the submarine 12 is disposed, as by one or more inlets 30. Thus, the tank first zone 24 is subject to free flooding through the openings 28. The tank second zone 26 is in communication with a launch tube inlet line 32.

The plunger 22 includes a rigid disc 34 and a flexible and substantially non-stretchable seal 36 fixed to a periphery of the disc 34 and to an internal wall 38 of tank 20. The seal 36 permits movement of the disc 34 in tank 20 while maintaining separation of tank zones 24, 26. The disc 34 preferably is circular in configuration and the seal is annularly shaped.

The assembly further includes a check valve 40 which interconnects the water environment with launch tube inlet line 32. As shown in FIG. 1, the check valve 40 is in communication with water tank 20 by way of the inlet line 32. The inlet line 32 is in communication with torpedo tubes 42, 44 or other vehicle launch conduits.

An actuator 50 may be mounted in the free flood zone 18 and is connected to plunger 22 and is operable to move plunger 22 in water tank 20. The actuator 50 can include a cylinder 52 in which is disposed a piston 54 fixed to a drive rod 56 connected to the disc 22.

A triggering and reset device 60 can be mounted within the pressure hull 16 and may comprise a hydraulic valve 62 to energize a selected one of a triggering hydraulic line 64 and a resetting hydraulic line 66. Although not shown a rest position not communicating hydraulic fluid can also be provided. The hydraulic lines 64, 66 extend from the triggering and reset device 60 to the actuator 50. Thus, by operation of the triggering and reset device 60, hydraulic force may be brought to bear on piston 54 in cylinder 52 to move plunger 22 in water tank 20.

In operation, a launch is initiated by an operator's actuation of the triggering and reset device 60, as by pushing a "fire" button 68, which pressurizes triggering hydraulic line 64, which, in turn, forces piston 54 toward water tank 20. The movement of piston 54 and drive rod 56 causes similar movement of plunger 22 toward the water tank second zone 26, to push water from the tank second zone 26 into the inlet line 32 and thence into selected launch tubes 42, 44. The movement of water out of tank second zone 26 closes check valve 40 and effects launch of a vehicle into the water environment.

Upon the operator's pushing a "reset" button 70, or the like, the triggering hydraulic line 64 is evacuated and the resetting hydraulic line 66 is pressurized. The piston 54 is moved so as to move plunger 22 toward the tank first zone 24, to force water out of the openings 28 to enlarge the tank second zone to draw water into the tank second zone 26 through the check valve 40.

The water tank 20 and plunger 22 are sized according to the quantity of water required for a launch. It has been found that the diameter of disc 34 should be about one half the diameter of the cylindrically shaped tank 20. The seal 36 must be large enough to permit the disc 34 to make a complete stroke. The diameter of plunger 22 preferably is large enough to accommodate a slow stroke speed, for acoustic performance, but small enough to be easily mounted in a typical platform. In a preferred arrangement, the plunger 22 is provided with a diameter of about six feet, which enables a two foot stroke to displace about 55 $ft^3$, the necessary volume of water for a typical launch.

Figure 4:
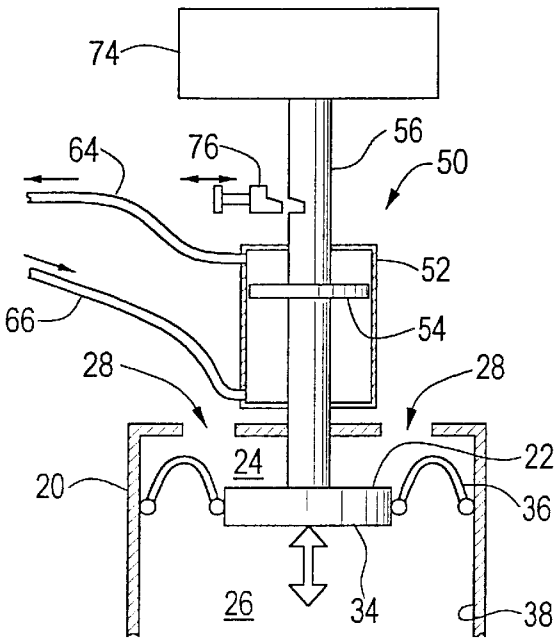
FIGS. 2–8 are diagrammatical views of portions of alternative embodiments of vehicle launch assemblies.
Figure 3:
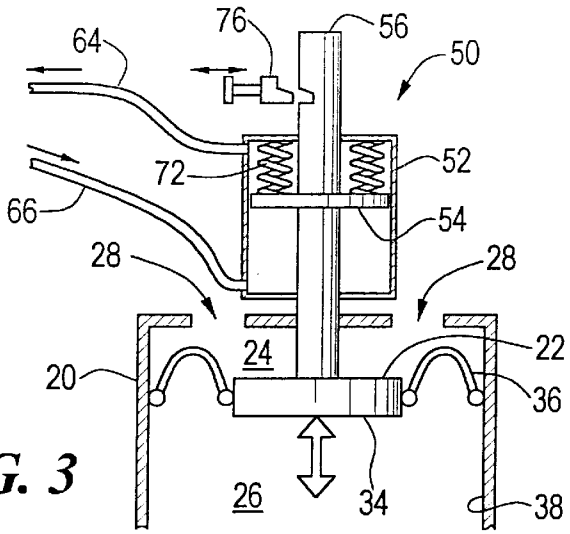
Figure 2:
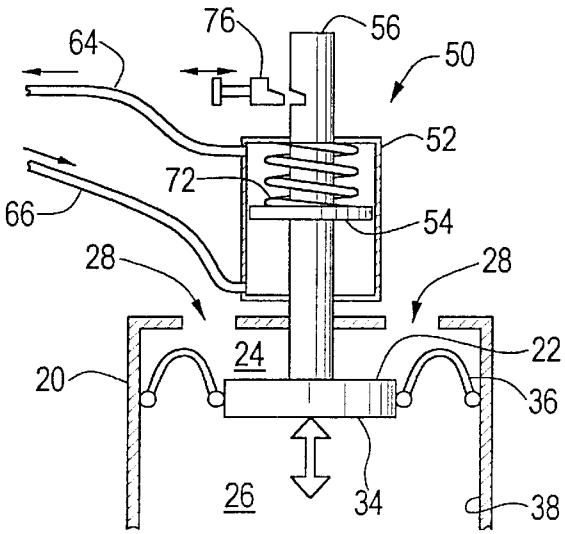

In FIGS. 2 and 3, it will be seen that the cylinder 52 of the actuator 50 may be provided with one or more springs 72 exercising a bias on piston 54. Alternatively, other means, such as a weight 74 (FIG. 4) may be used to exercise a similar bias. In such instances, a mechanical key 76 may be used to lock the drive rod 56 in place when the assembly is in "reset" mode. Pushing the "fire" button 68 serves not only to flow hydraulic fluid to cylinder 52, but also to release key 76 from locking position. Thus, the resulting stroke of plunger 22 is powered by hydraulic fluid in combination with spring power (FIGS. 2 and 3) or weight created force (FIG. 4). In resetting, the hydraulic force supplied to cylinder 52 must be such as to overcome the force of spring 72 or weight 74.

Figure 5:
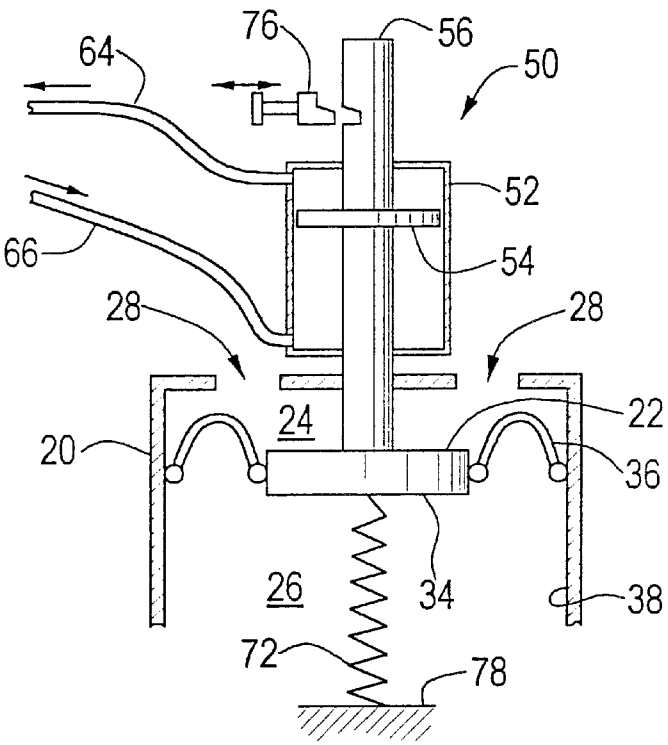

In FIG. 5, there is illustrated an alternative embodiment in which spring force is used in a firing episode, but the spring 72 is disposed in the tank second zone 26, interconnecting the disc 34 and a wall 78 of tank 20 opposed to disc 34. The manner of operation of the embodiment of FIG. 5 is similar to that of the embodiments of FIGS. 2–4.

Figure 6:
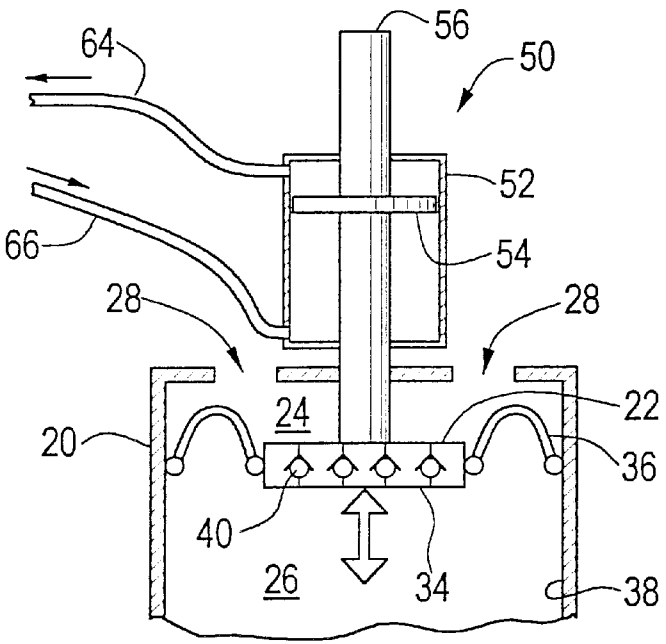

In FIG. 6, there is shown an alternative embodiment in which the check valve 40, or a plurality of check valves, are disposed in disc 34. Check valves can be any one way fluid flow valve allowing flow from first zone 24 to second zone 26 and preventing flow from second zone 26 to first zone 24. When the plunger 22 is forced to move in the direction of the second zone 26, check valves 40 are closed, but when plunger 22 is moved into the "reset" mode, water from the first zone 24, that is, from the free flood zone 18, flows through disc 22 and into tank second zone 26.

Figure 7:
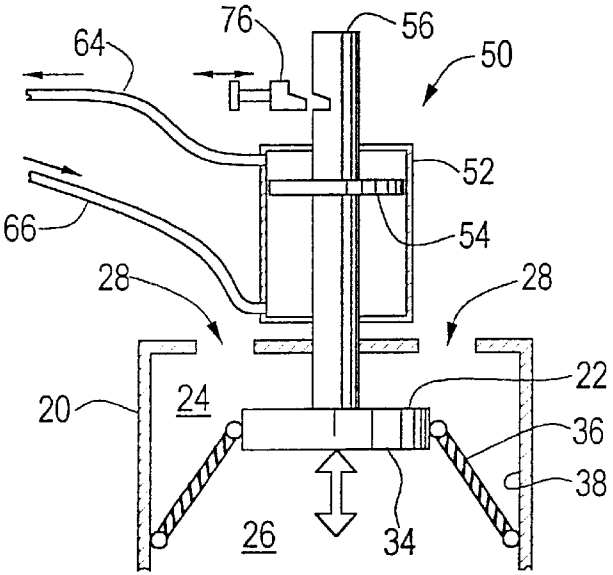

In FIG. 7, there is shown an alternative embodiment in which the annular seal 36 also serves as a spring. In this embodiment, the seal 36 is of an elastomeric material having a stretch capability, such that upon release of key 76, and injection of hydraulic fluid into cylinder 52, the seal exercises a spring force on disc 34, to add to the hydraulic force in moving plunger 22 in a firing direction.

Figure 8:
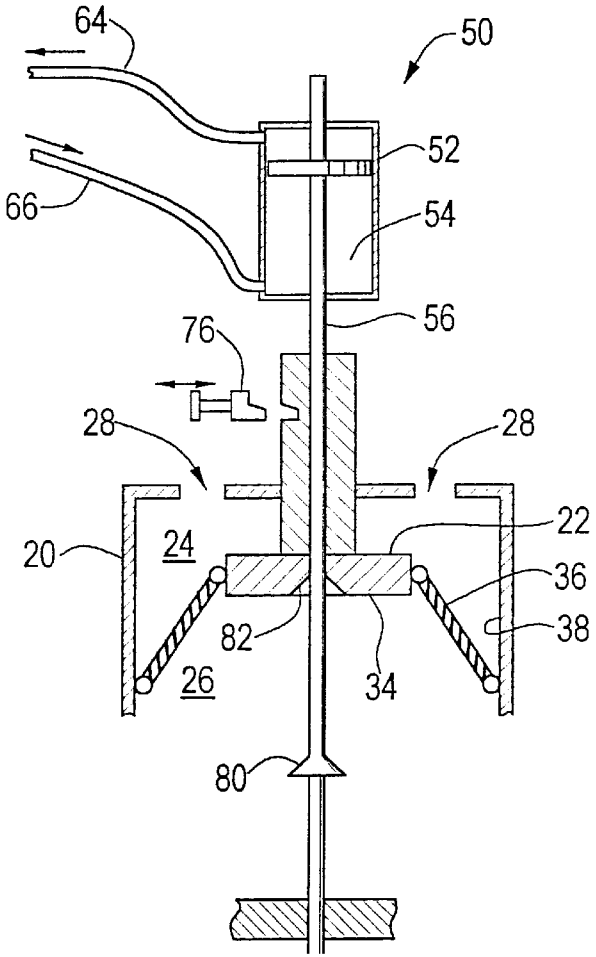

In a further alternative embodiment, shown in FIG. 8, the assembly is similar to that shown in FIG. 7, except that actuator 50 is discrete from plunger 22, the latter being "fired" by removal of key 76 from a locking position. In operation, resetting hydraulic line 66 is activated to move piston 54 in cylinder 52 to move rod 56 so that a body 80 fixed on rod 56 engages disc 34, as by engaging a complementary shaped recess 82 in the second zone face of disc 34. The rod 56 thereby moves disc 34 into position for engagement by key 76 to hold the disc in place, with the seal/spring 36 stretched to exert a launch force on the disc 34.

To execute a launch, the hydraulic line 64 is activated to move body 80 away from disc 34, which is then retained only by key 76. Upon actuation of the "fire" button, the key 76 moves out of its locking position, releasing plunger 22 for a firing stroke.

While the above-described vehicle launch assembly is a unique combination of components providing operational advantages, each of the individual components is relatively simple and not complex or expensive to manufacture, maintain, or replace. Thus, the assembly provides substantial cost advantages with regard to both initial expense and maintenance expenses. Further, the simplicity of the individual components and lack of wearing parts provides further advantages in reliability of operation. Still further, inasmuch as no mechanical interaction occurs between the plunger 22 and the tank 20, no mechanical noise is generated in a firing or resetting stroke. Even small noises and vibrations, such as are generated by hydraulic fluid flow, triggering a launch, and drive rod axial motion, are minimal because there is no high speed mechanical motion. Any such minimal mechanical noises generated have been found to fall below the existing water flow noises.

Accordingly, the above-described launch assembly has been found to overcome the prior art challenges of high cost of manufacture and maintenance, troublesome reliability, and generation of pronounced acoustic signals.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. A vehicle launch assembly providing pressurized water to a launch tube mounted on an underwater platform, said assembly comprising:

a water tank mounted on the platform;

a plunger movably disposed in said tank and dividing said tank into first and second zones, said first zone being in communication with a water environment in which the platform is disposed, said second zone being in communication with the launch tube;

an actuator connected to said plunger and operable to move said plunger in said tank;

a check valve positioned to allow entry of water from the water envirorunent into the second zone; and a triggering and reset device for initiating operation of said actuator to move said plunger in said tank to effect a selected one of moving said plunger to push water from the tank second zone to the launch tube, and moving said plunger to enlarge the tank second zone to draw water thereinto from said check valve, to reset said plunger for a further operative stroke;

wherein said plunger comprises:

a rigid circular disc joined to said actuator; and an annular flexible seal fixed to a periphery of said disc and to an internal wall of said tank, said seal permitting movement of said disc in said tank while maintaining separation of the first and second zones.

2. The assembly in accordance with claim 1 wherein said actuator comprises:

a hollow cylinder;

a drive rod extending from said cylinder and connected to said disc;

a piston fixed to said drive rod and disposed in said cylinder; and force means in said cylinder and acting on said piston to move said drive rod and thereby move said disc in said tank.

3. The assembly in accordance with claim 2 wherein said triggering and reset device comprises:

a hydraulic valve; and said force means comprises hydraulic fluid having a differential pressure, said hydraulic valve being operable to effect the differential pressure on first and second surfaces of said piston to drive said drive rod, and thereby said disc, in said tank.

4. The assembly in accordance with claim 1 wherein said platform comprises a submarine and said tank is mounted outside of a pressure hull of the submarine.

5. The assembly in accordance with claim 1 wherein said check valve is disposed in said plunger and extends from the first zone to the second zone a d permits water flow from the first zone to the second zone when said plunger is moved toward the first zone, but does not permit water flow from the second zone to the first zone when said plunger is moved toward the second zone.

6. The assembly in accordance with claim 1 wherein said tank is cylindrically-shaped and of a first diameter, said disc is of a second diameter, and the second diameter is about one-half of the first diameter.

7. The assembly in accordance with claim 6 wherein a diameter of said plunger is about six feet.

8. The assembly in accordance with claim 1 wherein said seal is inelastic.

9. The assembly in accordance with claim 3 wherein said force means further comprises a spring biasing said piston in a direction for moving said plunger toward the second zone.

10. The assembly in accordance with claim 9 wherein said triggering and reset device further comprises key means for retaining said shaft in a stationary condition, said key means being selectively movable to release said drive rod for movement.

11. The assembly in accordance with claim 3 wherein said force means further comprises a weight biasing said drive rod in a direction for moving said plunger toward the second zone.

12. The assembly in accordance with claim 3 wherein said force means further comprises a spring extending from said disc to an opposed end wall of said tank and biasing said disc in a direction toward the second zone.

13. A vehicle launch assembly for an underwater platform and providing pressurized water to a launch tube mounted on the platform, said assembly comprising:

a water tank mounted on the platform;

a plunger movably disposed in said tank and dividing said tank into first and second zones, the first zone being in communication with a water environment in which the platform is disposed, the second zone being in communication with the launch tube, said plunger comprising a rigid disc and an annular elastomeric seal fixed to a periphery of said disc and to an internal wall of said tank, said seal being stretchable to provide a bias on said plunger in a direction toward the second zone;

a key means joined to said plunger for retaining said disc in a stationary condition, said key means being selectively movable to release said plunger for movement in response to the bias of said elastomeric seal on said plunger disc; and a reset device comprising a hollow cylinder, a drive rod extending from said hollow cylinder and connected to said plunger disc, a piston fixed to said drive rod and disposed in said hollow cylinder, and force means acting within said hollow cylinder and acting on said piston to move said drive rod, thereby moving said disc in said tank.

14. The assembly in accordance with claim 13 wherein said force means comprises at least one of hydraulic fluid force and spring force.

15. A vehicle launch assembly for an underwater platform, for providing pressurized water to a launch tube mounted on the platform said assembly comprising:

a water tank mounted on the platform;

a plunger movably disposed in said tank and dividing said tank into first and second zones, the first zone being in communication with a water environment in which the platform is disposed, and the second zone being in communication with the launch tube, said plunger comprising a rigid disc and an annular elastomeric seal fixed to a periphery of said disc and to an internal wall of said tank, said seal being stretchable to provide a bias on said plunger in a direction toward the second zone;

a triggering device comprising key means for retaining said plunger in a stationary condition, said key means being selectively movable to release said plunger for movement in response to the bias of said elastomeric seal on said plunger disc in a direction toward the second zone to effect launch of a vehicle from the launch tube; and a reset device comprising an actuator, a shaft extending from said actuator and slidingly through said disc, a body fixed to said shaft in the second zone outside said disc, and said actuator acting on said shaft to move said body into engagement with said plunger to move said plunger in said tank to a position wherein said plunger is engageable by said key means.

* * * * *